US008887354B1

(12) United States Patent
Weinman

(10) Patent No.: US 8,887,354 B1
(45) Date of Patent: Nov. 18, 2014

(54) CLIP FOR MODEL CONSTRUCTION

(76) Inventor: Jeremy Eugene Weinman, Derby, KS (US)

( * ) Notice: Subject to any disclaimer, the term of this patent is extended or adjusted under 35 U.S.C. 154(b) by 219 days.

(21) Appl. No.: 13/527,201

(22) Filed: Jun. 19, 2012

Related U.S. Application Data

(60) Provisional application No. 61/525,453, filed on Aug. 19, 2011.

(51) Int. Cl.
*A63H 33/04* (2006.01)
*E05D 7/12* (2006.01)

(52) U.S. Cl.
CPC ..... *E05D 7/12* (2013.01)
USPC ..... 16/252; 24/336; 24/499; 24/521; 24/545; 24/564; 24/329; 16/342; 16/266; 16/267

(58) Field of Classification Search
CPC ..... A45F 5/02; A45F 5/021; A45F 2200/05; A45F 2200/055; A41B 3/08
USPC ..... 24/329, 336, 335, 326, 455, 499, 521, 24/545, 564, 546, 551, 556; 16/342, 266, 16/267, 252
See application file for complete search history.

(56) References Cited

U.S. PATENT DOCUMENTS 1,343,623 A * 6/1920 Graske ..... 24/66.3
1,398,852 A 11/1921 Gilbert
1,564,611 A * 12/1925 Mountford et al. ..... 16/322
2,732,581 A * 1/1956 Heck ..... 220/840
3,013,654 A 12/1961 Hoff et al.
4,253,268 A 3/1981 Mayr
4,521,035 A 6/1985 Berezowsky
5,100,358 A 3/1992 Volgger
5,172,534 A * 12/1992 Milner et al. ..... 52/632
5,175,913 A 1/1993 Mackie et al.
D365,221 S 12/1995 Erickson
5,487,690 A 1/1996 Stoffle et al.
5,630,587 A 5/1997 Zlotsky
5,725,251 A 3/1998 Heggeland
6,176,757 B1 1/2001 Lin
6,263,543 B1 * 7/2001 Daoud ..... 16/342
6,447,358 B1 * 9/2002 Mikkelsen et al. ..... 446/85
6,926,363 B2 * 8/2005 Yamashita ..... 297/366
8,024,839 B2 * 9/2011 Lewis, II ..... 16/266
2008/0307615 A1 * 12/2008 Hein et al. ..... 24/455
2010/0130094 A1 5/2010 Michalk et al.

* cited by examiner

*Primary Examiner* — Robert J Sandy
*Assistant Examiner* — Michael Lee

(57) ABSTRACT

A construction clip includes a pair of generally identical clip members. Each clip member has a base portion and two converging opposing flanges extending from the base portion. The clip members are hinged together at their respective base portions. The converging opposing flanges of each clip member include a generally flat base flange and an opposing clip flange. The base flange presents a generally flat inside surface suitable for contacting a generally flat, thin piece of model construction media. The base flange further includes an opening. The clip flange has a curved distal end that preferably extends to the opening defined in the base flange and a distal edge that curves away from the generally flat inside surface of the base flange. The clip flange has a return flange that originates at a location toward the distal end of the clip flange and extends toward the base portion.

6 Claims, 6 Drawing Sheets

CLIP FOR MODEL CONSTRUCTION

RELATED APPLICATION

This application claims the benefit of U.S. Provisional Patent Application Ser. No. 61/525,453 filed on Aug. 19, 2011 which is incorporated herein by reference.

FIELD

This invention relates to an adjustable clip for connecting construction media for constructing model structures.

BACKGROUND

Building model structures from common materials such a cardboard or cloth is an educational and entertaining activity. Prior clips have been devised for connecting cardboard and the like to build model structures. Sometimes it is useful to integrate cloth into a model structure. Prior clips are not well adapted to engage cardboard and cloth. What is needed is a construction clip that will securely connect with a variety of materials such as corrugated cardboard, rigid card stock and cloth.

SUMMARY

The above described needs are addressed by a construction clip for fastening together various types of model construction media. The construction clip includes a pair of generally identical clip members. Each clip member has a base portion and two converging opposing flanges extending from the base portion. The clip members are hinged together at their respective base portions. The converging opposing flanges of each clip member include a generally flat base flange and an opposing clip flange. The base flange presents a generally flat inside surface suitable for contacting a generally flat, thin piece of model construction media. The base flange further includes an opening. The clip flange has a curved distal end that preferably extends toward the opening defined in the base flange and a distal edge that curves away from the generally flat inside surface of the base flange. The clip flange has a return flange that originates at a location toward the distal end of the clip flange which extends toward the base portion and also angles away from the clip flange toward the base flange.

DETAILED DESCRIPTION

Figure 1:
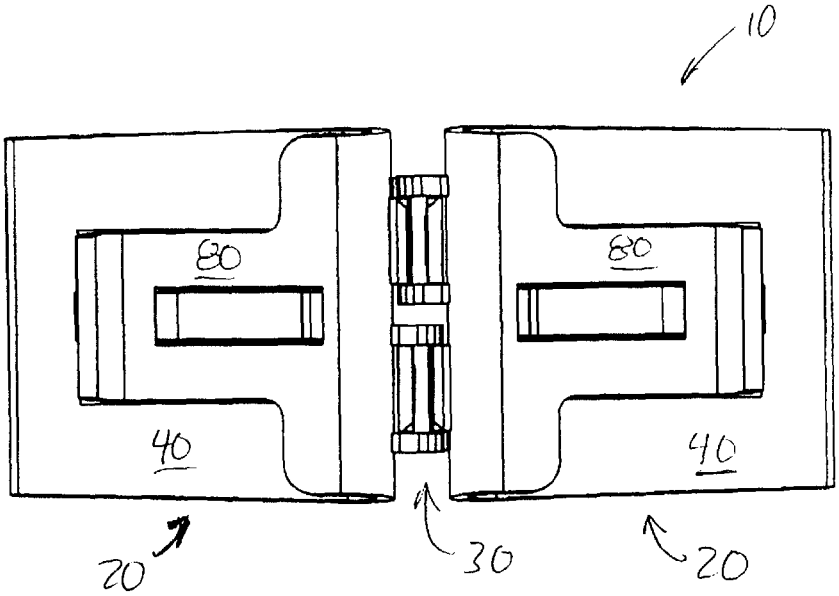
FIG. 1 is a plan view of a construction clip.

Referring to the drawings, FIG. 1 illustrates a hinged construction clip 10 including two generally identical clip members 20 which are connected together by an interlocking, releasable hinge structure 30. As can be seen in FIG. 1, each clip member 20 includes a base flange 40 and a clip flange 80. Base flange 40 and clip flange 80 both extend from a curved resilient base portion 102.

Figure 3:
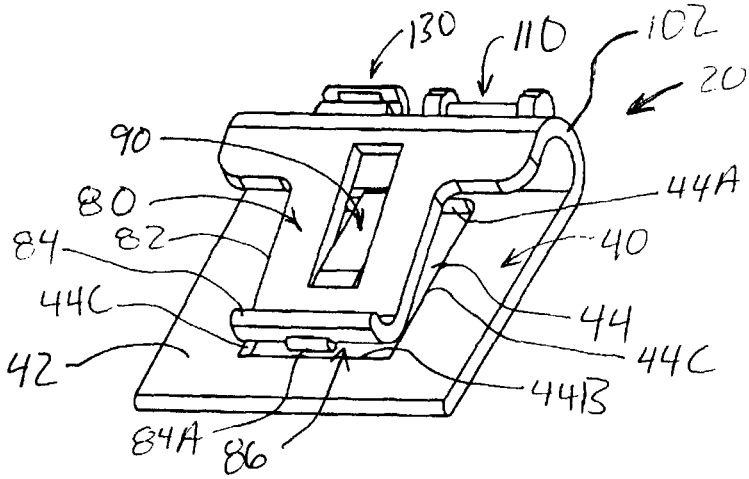
FIG. 3 is a perspective view of a clip member.

The configurations of base flange 40 and clip flange 80 are complementary and may be best understood by considering each separately. As can be best seen in FIG. 3, base flange 40 connects at its proximal end to curved base portion 102 and extends to its distal end. Base flange 40, in this example, is generally rectangular in shape and presents a flat inside surface 42. In this example, base flange 40 has an base flange opening 44 that extends across most of the length of base flange 40 and about one half of the width of base flange 40. In this example, base flange opening 44 is rectangular and is centered on base flange 40 in the transverse direction and is located to leave a margin at the distal end of base flange 40 in the longitudinal direction. As can be seen in FIG. 3, base flange opening 44 includes a proximate edge 44A located near curved resilient base portion 102, a distal edge 44B located opposite from proximate edge 44A and two side edges 44C connecting between the opposite ends of proximate edge 44A and distal edge 44B.

Figure 2:
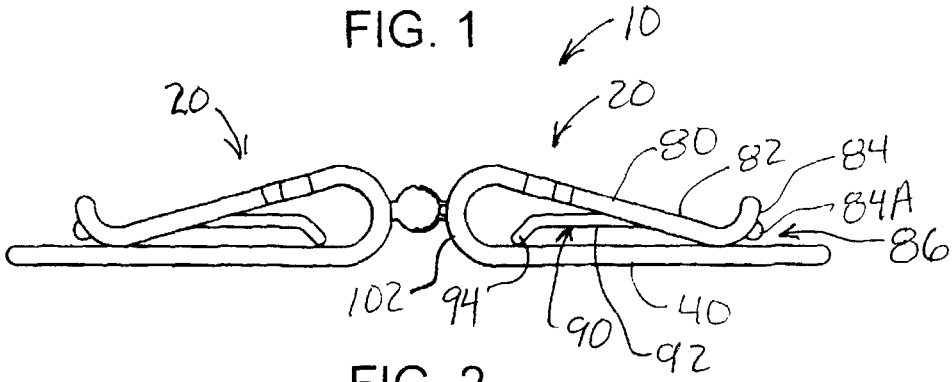
FIG. 2 is a side view of a construction clip.

As can be seen in FIG. 3, clip flange 80 also extends from curved resilient base portion 102. Clip flange 80 extends from its proximal end to its distal end. In this example, clip flange 80 is substantially narrower than base flange 40 along most of the length of clip flange 80 towards its distal end. Preferably, the width of the distal end of clip flange 80 corresponds with the width of base flange opening 44 so that the profile of the distal end of clip flange 80 generally corresponds with the outline of at least the distal end of base flange opening 44. The distal end of clip flange 80 is not straight and flat as is the case with base flange 40. Rather, the distal end of clip flange 80 is curved to define a curved receiving portion 84 that terminates at a distal edge 84E that is spaced away from base flange 40. Thus, clip flange 80 can be said to have a flat portion 82 and a curved receiving portion 84. Curved receiving portion 84 curves away from the plane defined by the inside surface 42 of base flange 40. As can be seen in FIG. 2, in this example, flat portion 82 of clip flange 80 converges toward base flange 40. Curved receiving portion 84 curves away from the distal end of flat portion 82. Thus, curved receiving portion 84 and base flange 40 define a transverse, elongated opening 86 shown in FIG. 2 which is suitable for receiving the edge of a piece of model construction material such as a piece of cardboard. Curved receiving portion 84 extends so that a portion of its inside surface is either a co-planer with or extends slightly past inside surface 42 of base flange 40. A portion of curved receiving portion 84 at least comes into close proximity to inside surface 42 of base flange 40. Base flange 40, base portion 102 and clip flange 80 combine to make a flexible structure that is sufficiently flexible so that receiving portion 84 of clip flange 80 and base flange 40 are able to flex apart to receive a piece of construction material. Yet, these elements are sufficiently rigid to securely grip a flat piece of model construction material such as card stock or corrugated cardboard when such material is placed between clip flange 80 and base flange 40.

As can be seen in FIGS. 2 and 3, clip flange 80 carries a return flange 90. Return flange 90 extends from the distal end of flat portion 82 of clip flange 80 and extends to the proximate edge of rectangular opening 44 of base flange 40. As can be seen in FIG. 2, return flange 90 includes a generally straight portion 92 and a relatively short end portion 94 that extends away from straight portion 92 and terminates in close proximity to proximate edge 44A of rectangular opening 44.

Figure 5:
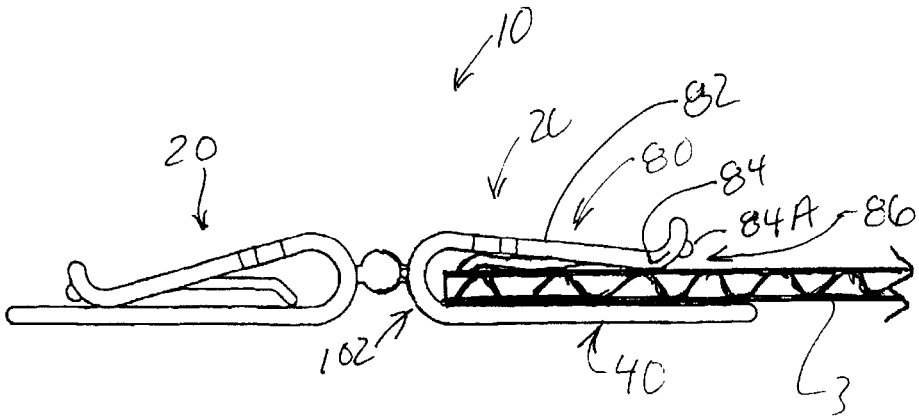
FIG. 5 is a side view of a construction clip showing one clip member receiving a piece of corrugated cardboard construction media.

The configuration described above provides several advantages for those wishing to used construction clip 10 to connect pieces of construction media to build a model structure. First, the user may push his or her thumb or finger through base flange opening 44 to push clip flange 80 open to accept a relatively thick piece of construction media such as corrugated cardboard. Secondly, the end portion 94 of return flange 90 provides a third pressure point for securing a piece of construction media as can be seen in FIG. 5. Accordingly, pieces of construction media are clamped not just between the distal ends of base flange 40 and clip flange 80 but also near the proximate ends of base flange 40 and clip flange 80. Thirdly, the placement of the distal ends of clip flange 80 and end portion 94 of return flange 90 near the periphery of base flange opening 44 makes it possible to secure thin pieces of material and makes it possible to even secure cloth so that pieces of fabric or flexible plastic sheet material may be added as a material in the construction of a model structure.

Figure 6:
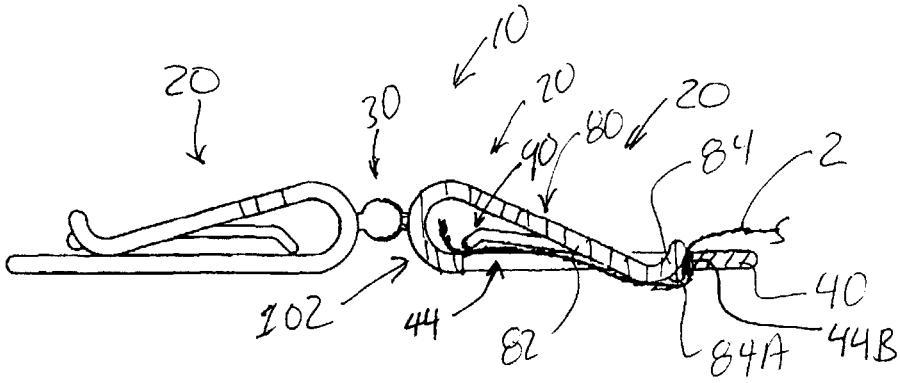
FIG. 6 is a side view of a construction clip showing one clip member receiving a piece of cloth.
Figure 7:
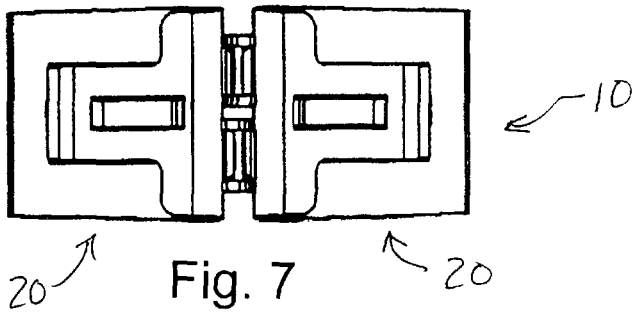
FIG. 7 is plan view of a construction clip.
Figure 7A:
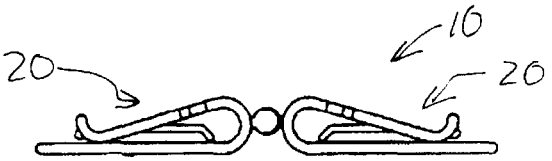
FIG. 7A is a side view of the construction clip of FIG. 7.
Figure 7B:
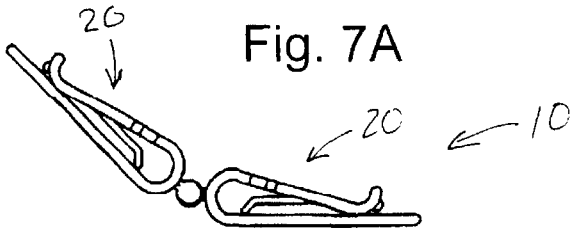
FIG. 7B is a side view of the construction clip of FIG. 7 with the left clip member rotated at 45 degrees.
Figure 7C:
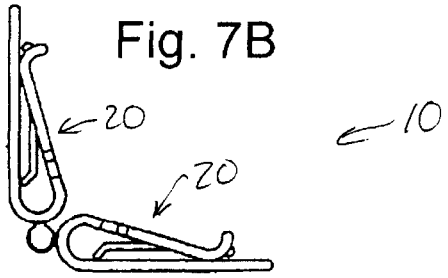
FIG. 7C is a side view of the construction clip of FIG. 7 with the left clip member rotated at 90 degrees.

The securing of fabric or thin plastic sheet material is illustrated in FIG. 6. A boss 84A projects from the outside surface of curved receiving portion 84 of clip flange 80. Boss 84A is generally elongated and is generally parallel to and spaced away from the distal end of curved receiving portion 84. Boss 84A and the distal end of curved receiving portion 84 are shaped, sized and spaced so that it is possible to detain clip flange 80 with the distal edge 44B of opening 44 detained between the distal edge of curved receiving portion 84 and a boss 84A. This makes it possible to secure a piece fabric 2 between clip flange 80 and distal edge 44B of opening 44 as shown in FIG. 6. As can be seen in FIG. 6, which is a cut away view, fabric 2 follows a torturous path around the end of receiving portion 84 and between receiving portion 84 and distal edge 44B of opening 44. As can be seen in FIG. 6, boss 84A is located on one side of edge 44B while the distal end of curved receiving portion 84 is positioned on the other side of edge 44B. This configuration secures fabric 2 and basically snaps fabric 2 in place until it is released by manual pressure. Accordingly, fabric or any other sheet material (such as plastic sheeting) may be added as a construction material when constructing a model with construction clips 10.

Figure 4:
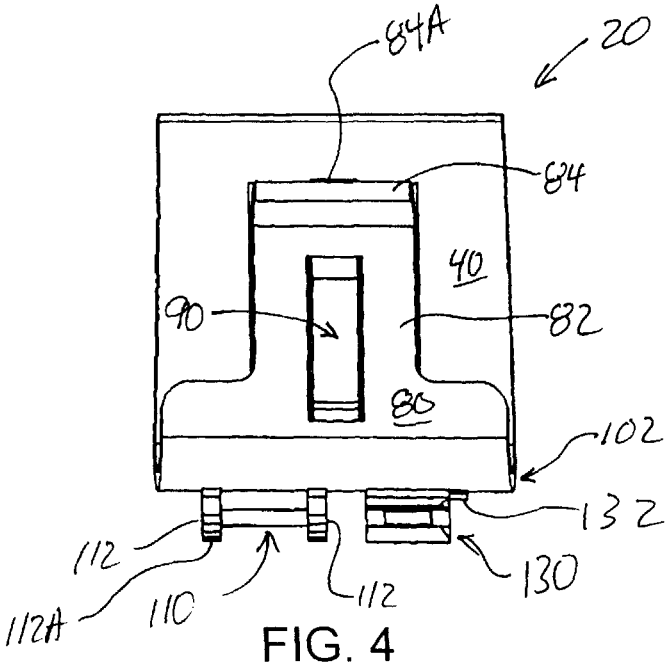
FIG. 4 is a plan view of a clip member.
Figure 4A:
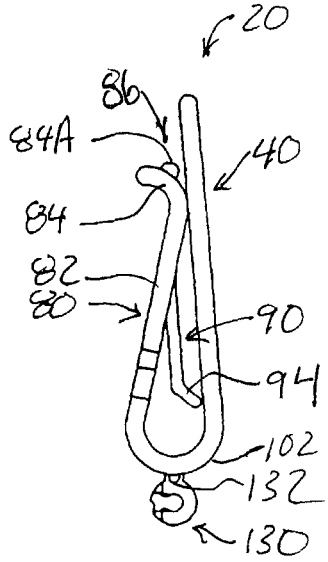
FIG. 4A is a side view of a clip member.
Figure 4B:
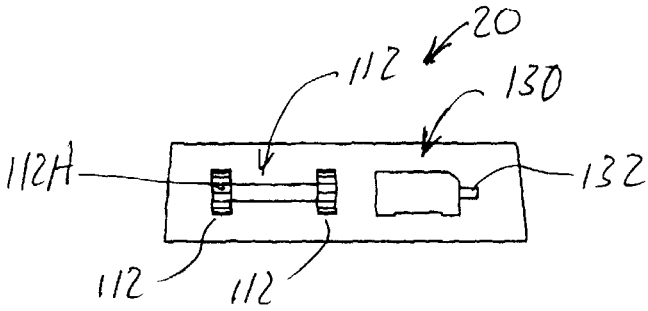
FIG. 4B is an end view of a clip member.

As can be seen in FIGS. 4, 4A and 4B, an offset hinge shaft 110 and a hinge clasp 130 extend from the outside surface of resilient base portion 102 of each clip member 20. Hinge shaft 110 extends parallel to base portion 102 and is mounted to base portion 102 by two supports 112 located at opposite ends of hinge shaft 110. Hinge clasp 130 is spaced away from hinge shaft 110 and presents a cylindrical clasp that is located, shaped and sized to receive and retain a corresponding hinge shaft 110 extending from a base portion of another clip member 20. In this example hinge clasp 130 carries a tab 132 extending from at least one end. Further, the outside surface of one of supports 112 presents a series of notches 112A. Notches 112A are located to progressively receive tab 132 as the hinge formed by hinge clasp 130 and hinge shaft 110 is rotated. Thus as the hinge is rotated, construction clip 10 click stops at pre-selected angles. This makes it possible for a user to select angles for orienting pieces of construction media as is illustrated in FIGS. 7, 7A, 7B and 7C.

Construction clips 10 may be best fashioned from injection molded plastic. It will be appreciated by those skilled in the art that the plastic selected should be both strong and resilient. It should also be possible to mold the plastic selected with a high degree of dimensional precision that is fully within the present state of the art.

Figure 8A:
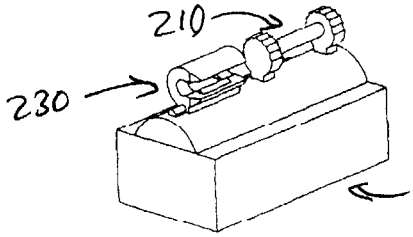
FIG. 8A is a first perspective view of a toy building block that presents a hinge shaft and a hinge clasp.
Figure 8B:
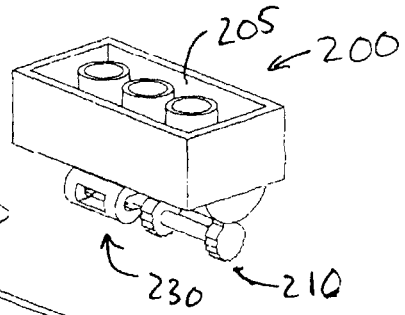
FIG. 8B is a second perspective view of a toy building block that presents a hinge shaft and a hinge clasp.
Figure 8C:
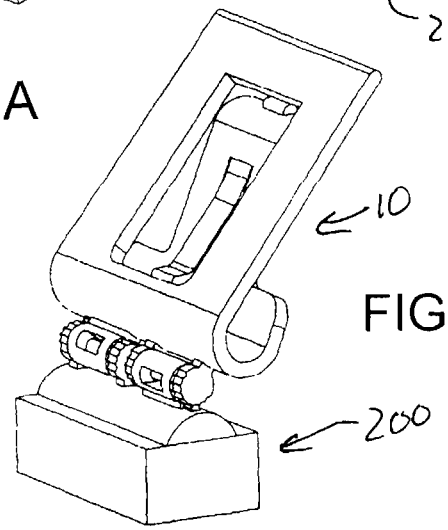
FIG. 8C is a perspective view of a toy building block that presents a hinge shaft and a hinge clasp connected to a clip member.

As can be seen in FIGS. 8A-8C, toy block 200 is an interchangeable injection molded plastic toy construction block 200 of the type having open spaces 205 that receive a pattern of bosses of a similar type block. Toy block 200 includes a hinge shaft structure 210 and a hinge clasp structure 230 that are configured to receive corresponding structures of a construction clip 10. Accordingly, clips 10 of the present invention, by using toy block 200, may be used to add construction elements to a model constructed with interchangeable toy plastic blocks such as LEGO® blocks.

Figure 9:
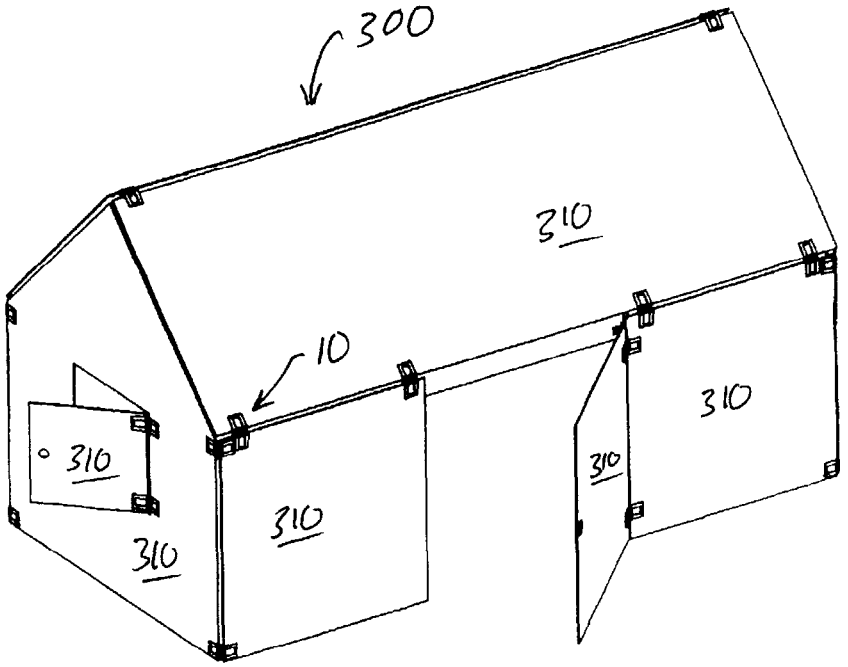
FIG. 9 is a perspective view of a model house constructed using cardboard panels connected together by construction clips.

As can be seen in FIG. 9, construction clips 10 are used to assemble a number of cardboard panels 310 to build a model house 300. The skilled reader will note how various panels are joined at various angles by clips 10 as described above to join the various panels of the model. This is shown as just one example of a myriad of construction models that may be constructed using construction clip 10. The skilled reader will appreciate that clips 10 may be used to connect a wide variety of materials including, for example, (but by no means limited to) card stock, cardboard, and rigid sheet plastic. By way of example, fabric and flexible sheet plastic may be secured by using boss 84A as shown in FIG. 6 and as described above.

Figure 10:
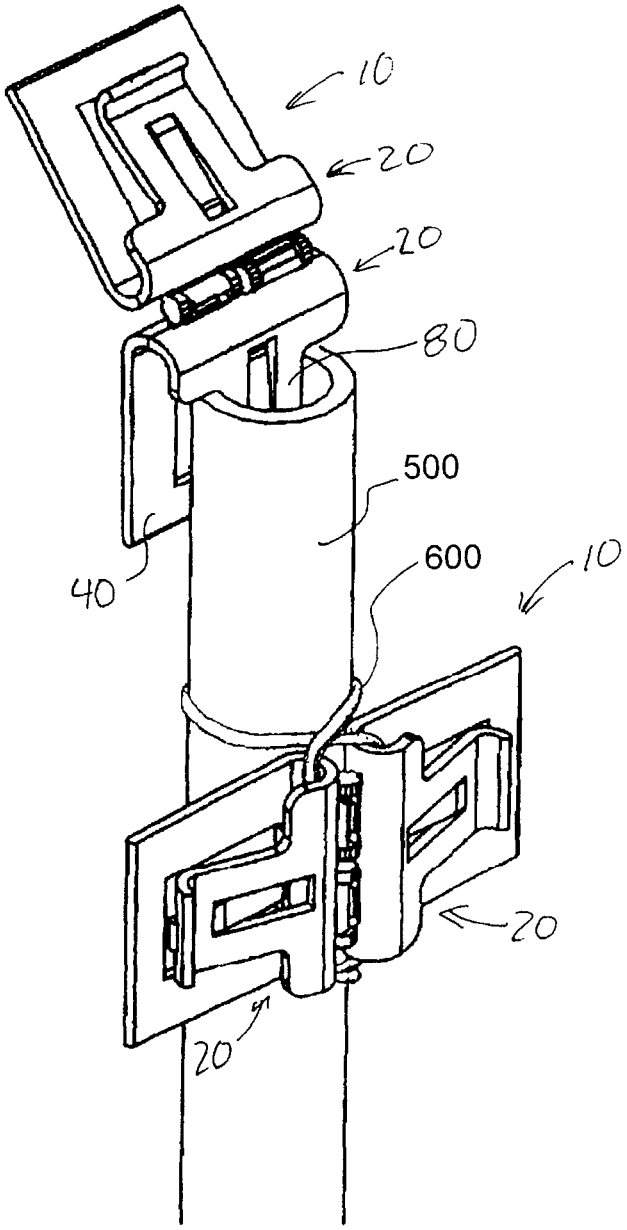
FIG. 10 is a perspective view of construction clips connected to the end of a standard pipe and secured to the side of a standard pipe by a standard rubber band.

As is shown in FIG. 10, a construction clip 10 may be secured to the open end of a cylinder such as a standard PVC pipe 500. Further, by using a standard rubber band 600, it is possible to secure a construction clip 10 to the side of a member such as pipe 500 as shown in FIG. 10.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A hinged clip for connecting generally flat, thin pieces of model construction media, comprising:

(a) a pair of clip members, each having a base portion and two converging opposing flanges extending from the base portion, the base portions of the clip members connected by a hinge suitable for allowing each clip member to rotate relative to the other clip member, (b) the converging opposing flanges of each clip member including a generally flat base flange and an opposing clip flange, (i) the base flange presenting an outside surface and a generally flat inside surface suitable for contacting a generally flat, thin piece of model construction media, the base flange further presenting an opening, (ii) the clip flange having a curved distal end that extends toward the opening of the base flange and a distal edge that is spaced away from the generally flat inside surface of the base flange, the clip flange having a return flange that originates at a location toward the distal end of the clip flange and extends toward the base portion, the return flange having a distal end that extends toward the inside surface of the base flange, the curved distal end of the clip flange further presenting a boss that is spaced away from the distal end of the clip flange, the distal end of the clip flange and the boss located and spaced so that the distal edge of the opening of the base flange is retained between the distal end of the clip flange and the boss when the boss is manually pushed past the distal edge of the opening of the base flange, whereby, a thin piece of flexible material may be retained between the clip flange and the base flange when such material is placed between the clip flange and the base flange and the clip flange is pressed into the opening of the base flange until the boss on the receiving portion of the clip flange catches the distal edge of the opening of the base flange.

2. The construction clip of claim 1, wherein:

the releasable hinge structures for connecting the clip members for each clip member includes a hinge shaft mounted to the base portion and extending parallel to the base portion and a hinge clasp spaced away from the hinge shaft, the hinge shaft and the hinge clasp spaced and located such that the hinge clasp will releasably clasp a corresponding hinge shaft of a second clip member and such that the hinge shaft will be releasably received by the hinge clasp of the second clip member, such that the interfitting hinge clasps and hinge shafts complete the hinge structure.

3. The construction clip of claim 1, wherein:

the releasable hinge structures for connecting the clip members for each clip member includes a hinge shaft mounted to the base portion and extending parallel to the base portion and a hinge clasp spaced away from the hinge shaft, the hinge shaft and the hinge clasp spaced and located such that the hinge clasp will releasably clasp a corresponding hinge shaft of a second clip member and such that the hinge shaft will be releasably received by the hinge clasp of the second clip member, such that the interfitting hinge clasps and hinge shafts complete the hinge structure, and wherein, the hinge clasp carries an extending tab and a pattern of notches is associated with the hinge, the notches being arranged to progressively receive the extending tab of a second clip member when a first and second clip member are hinged together and when they are rotated relative to each other, so that, as a first clip member is rotated with respect to the second clip member, the clip members stop at predetermined angles which are determined by the locations of the notches.

4. A construction clip comprising:

two generally identical clip members, each clip member having a base portion, a base flange and a clip flange, the base flange and the clip flange each having a proximate end connecting to opposite sides of the base portion and a distal end, the distal ends of the clip flange and the base flange converging, each clip member being flexible so that the distal ends of the base flange and the clip flange are operable to be manually spread apart to receive model construction material and to releasably clamp model construction material, each base portion of each clip member presenting corresponding hinge elements that are arranged to releasably engage each other to complete a hinge structure between the clip members, the base flange presenting an opening and the clip flange has at least a portion that is shaped to fit into the opening of the base flange, the clip flange having a curved receiving portion at the distal end of the clip flange that curves away from the base flange, the curved receiving portion of the clip flange cooperating with the base flange to define an elongated opening for receiving the edge of a flat piece of model construction material, the receiving portion of the clip flange further presenting a boss that is spaced away from the distal end of the clip flange, the distal end of the clip flange and the boss are located and spaced so that the distal edge of the opening of the base flange is retained between the distal end of the clip flange and the boss when the boss is manually pushed past the distal edge of the opening of the base flange, whereby a thin piece of flexible material may be retained between the clip flange and the base flange when such material is placed between the clip flange and the base flange and the clip flange is pressed into the opening of the base flange until the boss on the receiving portion of the clip flange catches the distal edge of the opening of the base flange.

5. The construction clip of claim 4, wherein:

the releasable hinge structures for connecting the clip members for each clip member includes a hinge shaft mounted to the base portion and extending parallel to the base portion and a hinge clasp spaced away from the hinge shaft, the hinge shaft and the hinge clasp spaced and located such that the hinge clasp will releasably clasp a corresponding hinge shaft of a second clip member and such that the hinge shaft will be releasably received by the hinge clasp of the second clip member, such that the interfitting hinge clasps and hinge shafts complete the hinge structure.

6. The construction clip of claim 4, wherein:

the releasable hinge structures for connecting the clip members for each clip member includes a hinge shaft mounted to the base portion and extending parallel to the base portion and a hinge clasp spaced away from the hinge shaft, the hinge shaft and the hinge clasp spaced and located such that the hinge clasp will releasably clasp a corresponding hinge shaft of a second clip member and such that the hinge shaft will be releasably received by the hinge clasp of the second clip member, such that the interfitting hinge clasps and hinge shafts complete the hinge structure, and wherein, the hinge clasp carries an extending tab and a pattern of notches is associated with the hinge, the notches being arranged to progressively receive the extending tab of a second clip member when a first and second clip member are hinged together and when they are rotated relative to each other, so that, as a clip member is rotated with respect to the second clip member, the clip members stop at predetermined angles which are determined by the locations of the notches.

* * * * *